United States Patent [19]

Nodwell et al.

[11] 4,027,185

[45] May 31, 1977

[54] HIGH INTENSITY RADIATION SOURCE

[75] Inventors: Roy A. Nodwell; David M. Camm, both of Vancouver, Canada

[73] Assignee: Canadian Patents and Development Limited, Ottawa, Canada

[22] Filed: Sept. 10, 1975

[21] Appl. No.: 612,091

Related U.S. Application Data

[63] Continuation-in-part of Ser. No. 478,872, June 13, 1974, abandoned.

[30] Foreign Application Priority Data

Apr. 1, 1975 Canada ..... 224438

[52] U.S. Cl. ..... 313/35; 313/44; 313/184; 313/231.7

[51] Int. Cl.[2] ..... H01J 61/28

[58] Field of Search ..... 313/35, 44, 184, 231.7

[56] References Cited

UNITED STATES PATENTS 3,366,815 1/1968 Anderson ..... 313/231.7 X

*Primary Examiner*—Rudolph V. Rolinec
*Assistant Examiner*—Darwin R. Hostetter
*Attorney, Agent, or Firm*—Edward Rymek

[57] ABSTRACT

The novel radiation source system of this invention includes a pair of electrodes which are coaxially mounted at each end of a single cylindrical transparent arc chamber. A liquid, such as water, is circulated through the arc chamber with a tangential velocity so as to form a vortexing liquid wall. The main functions of the liquid wall are to cool the periphery of the arc discharge between the electrodes thus constricting the arc diameter, and to absorb ultraviolet and infrared radiation which would otherwise be absorbed by the outer solid wall. This liquid wall produces a positive dynamic impedance for the arc discharge. In addition, a vortexing column of inert gas, injected through the length of the chamber, stabilizes the arc discharge between the electrodes. In one embodiment, the structure of the anode electrode includes an annular constriction which is mounted near the anode surface to constrict the diameter of the arc column near the anode and to form a gas expansion chamber adjacent to the anode surface wherein the inert gas on expansion loses its vortex motion. The arc is therefore no longer vortex stabilized and current density at the anode surface is reduced. In a further embodiment, the anode structure includes an expanding chamber at the anode into which both the liquid and the gas lose their vortex motion. A 3-stage starting and power supply circuit is connected across the electrodes. It includes a pulsing circuit to initiate the arc discharge across the fixed electrodes and a programmed capacitor bank to sustain the arc until such time that the main power supply, with its inherent high inductance, provides sufficient current to the radiation source to maintain the arc.

11 Claims, 8 Drawing Figures

HIGH INTENSITY RADIATION SOURCE

This application is a continuation-in-part of U.S. application Ser. No. 478,872, filed June 13, 1974, now abandoned, and relates to high intensity electric arc radiation sources.

Conventional stabilized arc high intensity radiation sources include a pressure vessel, a portion of which is transparent, and anode and cathode electrodes positioned coaxially within the vessel. An inert gas, such as argon, is passed through the vessel at about 4 atm and is given a radial velocity so that it forms a vortex which constricts and stabilizes the arc between the cathode and anode. An outer transparent jacket is usually provided such that transparent cooling liquid may be circulated between the outer surface of the vessel and the outer jacket to overcome the intense heat generated by the arc. An alternate method of cooling is described in U.S. Pat. No. 3,366,815 which was issued on Jan. 30, 1968 to J.E. Anderson assignor to Union Carbide Corp. In this method a small amount of liquid is bled into the arc chamber and is spread uniformly over the inner wall surface, by the vortexing gas to form a thin film. The device utilizes such a liquid film solely for the purpose of cooling the solid outer jacket and of absorbing unwanted radiation. In this and other conventional devices large gas flows are necessary to confine as well as stabilize the arc column, and also require an arc chamber with a relatively large diameter. Thus one of the major expenses in the lamp will be the gas recirculation system or the gas itself if it is not recirculated. In addition, the arc discharge in these devices have a negative dynamic impedance and therefore require current controlled power sources.

It is therefore an object of this invention to provide a high intensity radiation source with an arc discharge having a positive dynamic impedance.

It is another object of this invention to provide a high intensity radiation source having a stabilized arc which is long relative to its diameter.

It is a further object of this invention to provide a radiation source having a highly efficient cooling system for the arc itself as well as the solid envelope.

It is another object of this invention to provide a radiation source having a fixed electrodes.

It is a further object of this invention to provide a radiation source having an improved discharge starting circuit, It is another object of this invention to provide a radiation source which produces an efficient radiation output.

It is a further object of this invention to provide a radiation source wherein the electrodes and the arc chamber have a long operating life.

These and other objects are generally achieved in a radiation source system wherein a pair of electrodes between which an arc is discharged are coaxially mounted at each end of a single cylindrical transparent arc chamber. A liquid, such as water, is circulated through the arc chamber with a tangential velocity, to form a vortexing liquid wall in the interior of the chamber to cool the arc periphery and thus impart a positive dynamic impedance to the arc by constricting the arc. In addition, a column of inert gas, injected through the length of the chamber, stabilizes the arc discharge.

The anode structure may include an annular constriction mounted in front of the anode surface facing the cathode to form a gas expansion chamber adjacent the anode surface, or an expanding chamber about the anode such that the gas and the liquid expand and lose their vortex motion, the arc is thus no longer vortex stabilized at the anode surface.

Finally, a 3-stage starting and power supply circuit is connected across the electrodes. It includes a pulsing circuit to initiate the arc discharge across the fixed electrodes and a programmed capacitor bank to sustain the arc until such time that the main power supply, with its inherent high inductance, provides sufficient current to maintain the arc.

Figure 3:
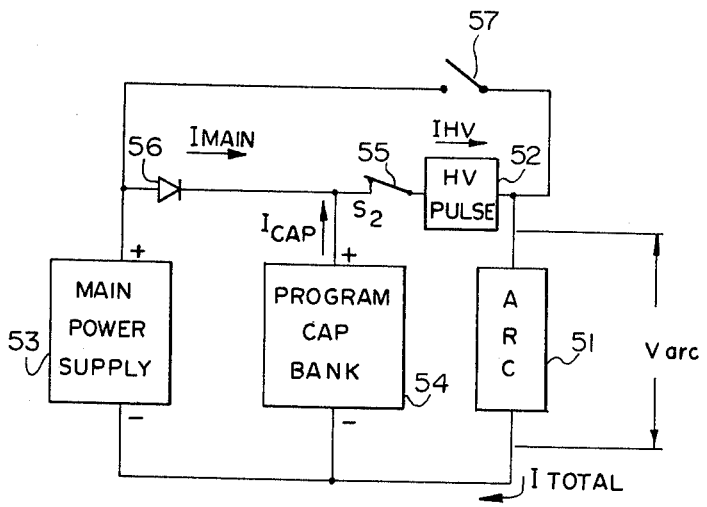
FIG. 3 illustrates the starting and power circuit for the radiation source.
Figure 4A:
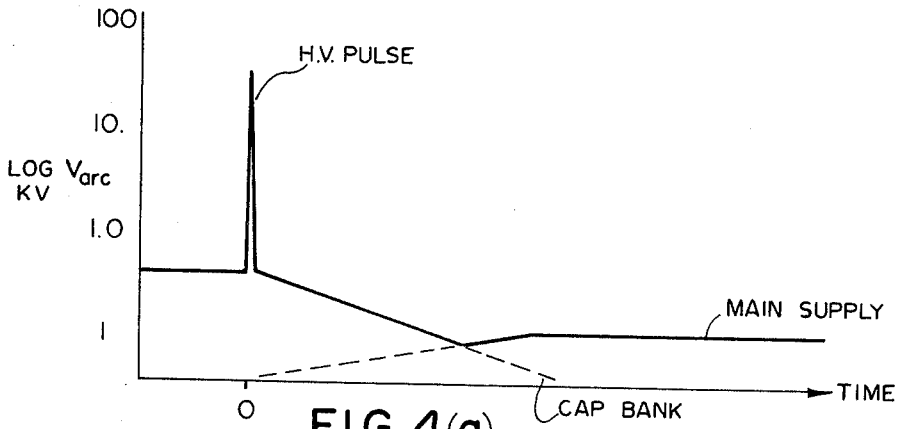
Figure 4B:
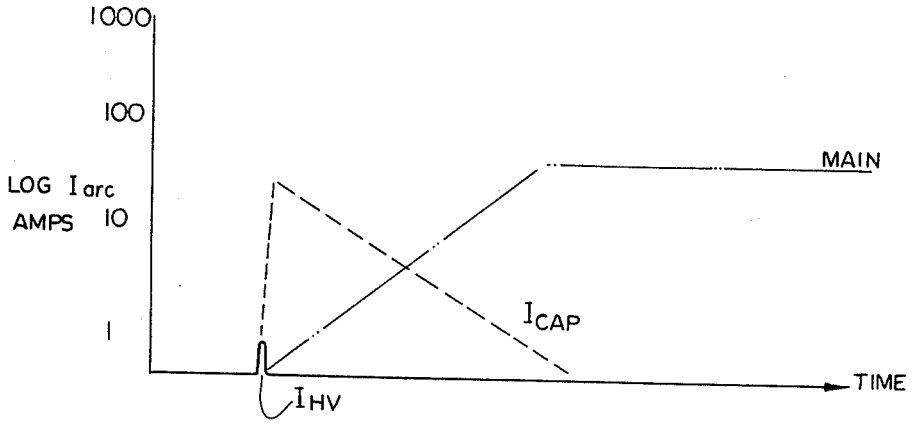

FIG. 4 (*a*) and 4 (*b*) are plots of the voltages and currents provided by the starting and power circuit in FIG. 3.

Figure 5:
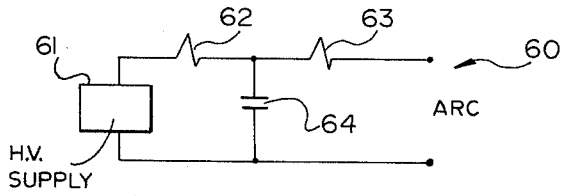
Figure 6:
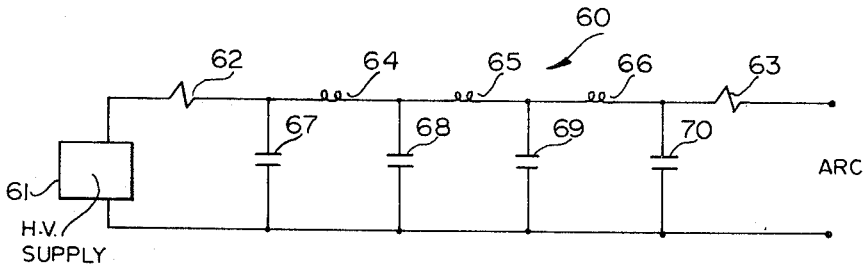

FIGS. 5 and 6 illustrate two types of capacitor banks for the starting and power circuit in FIG. 3.

Figure 7:
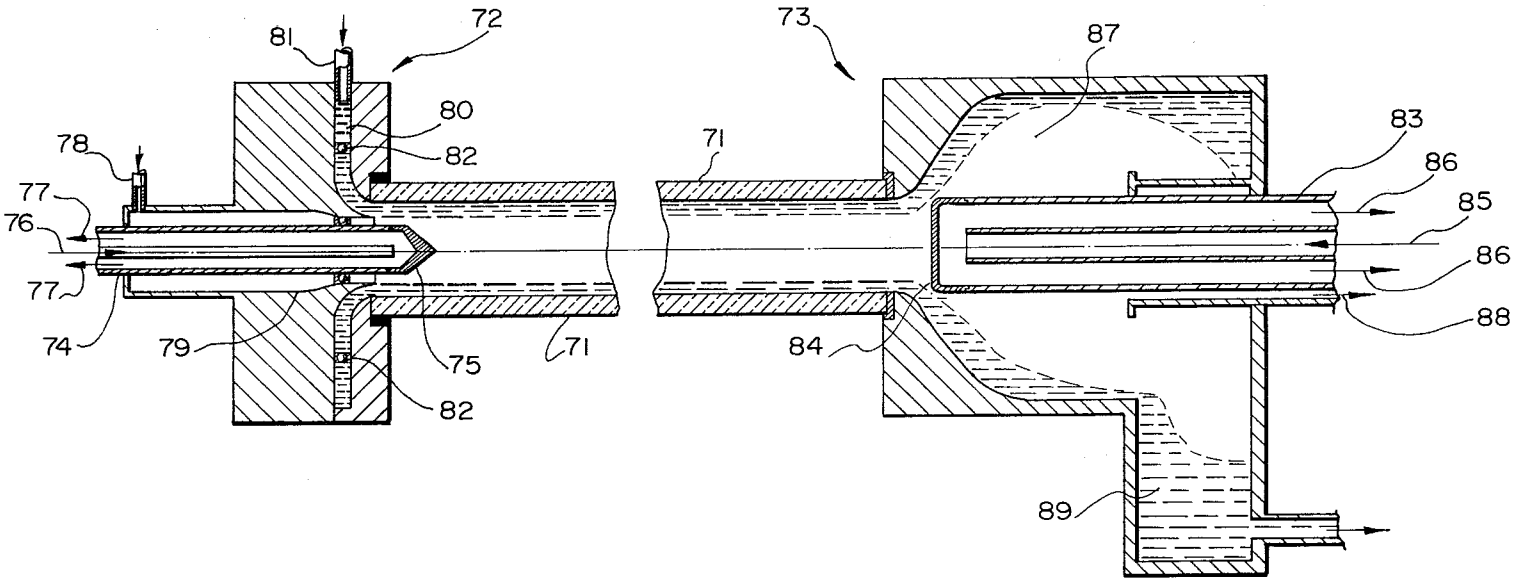

FIG. 7 illustrates, in cross-section, another radiation source in accordance with this invention.

The dynamic impedance of an arc is defined as the ratio of the incremental change in arc voltage resulting from an incremental change in current. In all arcs using vortexing gas to both stabilize and constricts the arc, a negative dynamic impedance is observed. This can be seen if the effect on the arc of a small current increase is considered. The higher current causes a higher current density which heats the arc column. The higher temperature arc not only has a lower resistivity but due to increased heating of the arc periphery the diameter of the arc becomes larger. This larger diameter and lower resistivity combine to lower the overall impedance of the discharge such that the voltage drop between the electrodes actually decreases with increased current. This situation continues until the arc diameter is restrained from increasing. In order to obtain an arc having positive dynamic impedance, it is therefore necessary to constrict the arc diameter.

Figure 1:
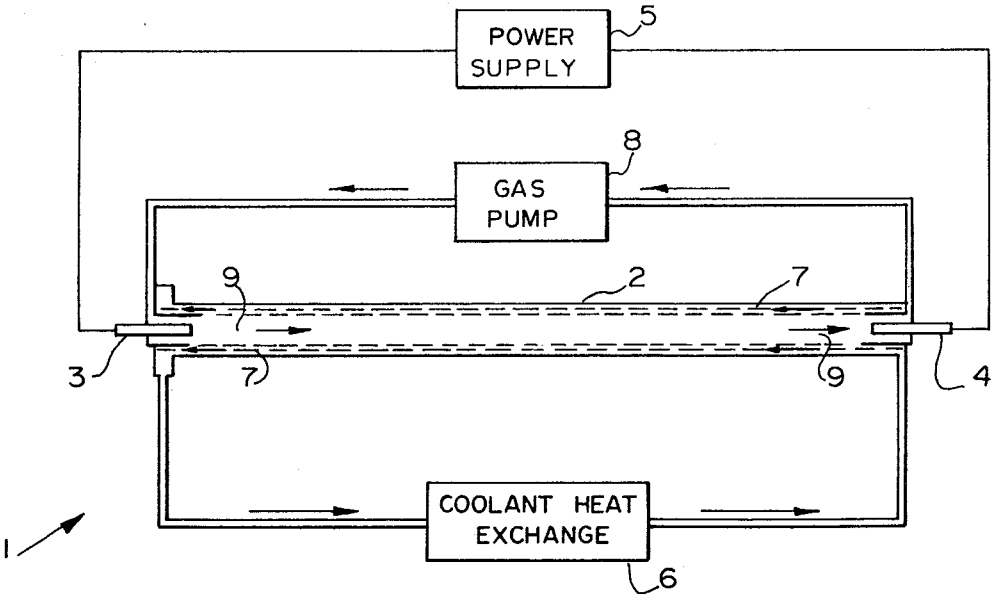
FIG. 1 illustrates schematically the radiation source system of this invention.

The principle of operation of the novel high intensity radiation source of this invention is illustrated schematically in FIG. 1. Source 1 includes a single cylindrical arc chamber 2 with spaced electrodes 3, 4 mounted coaxially at each end. Chamber 2 is made of material, such as quartz or pyrex, which is transparent to the radiation of the arc. A high current power supply 5 is connected across the electrodes. A liquid pump and heat exchanger 5 flows liquid into one end of the arc chamber 2 so as to produce a vortexing liquid cylinder 7 inside the arc chamber 2. A further pump may also circulate coolant through the electrodes 3 and 4 to maintain their temperature at a reasonably low level. A gas pump 8 circulates in inert gas 9 such as argon through the arc chamber 2 at a pressure above atmospheric, preferably between 2 and 50 atmospheres. The gas may be passed through chamber 2 in either direction. The vortexing liquid will transfer a vortexing motion to the gas entering the chamber, though means may further be provided to initially vortex the gas concentrically with the liquid as the gas enters.

The vortexing liquid cylinder or wall 7 cools the periphery of the gas column through which the arc is discharged. This cooling effect constricts the arc diameter. An increase in arc current will heat the arc, however since the liquid wall cools the arc periphery, a steeper temperature gradient occurs at the arc periphery and the arc is unable to expand. This fixed diameter gives the arc a positive dynamic impedance of approximately 0.005 to 0.1 ohms/cm. In addition, since the gas is not used to constrict the arc, but only to stabilize it, a low gas flow may be utilized.

For high power operation, the inside diameter of the liquid cylinder 7 must be small to constrict the arc and have a sufficient tangential velocity to maintain a uniform liquid wall throughout the chamber 2 without being appreciably perturbed by the gas column. The gas, on the other hand, requires only sufficient flow to stabilize the arc.

The radiation source of this invention provides many advantages:

1. The radiation source has a positive dynamic impedance and therefore the power supply and regulation equipment is much reduced in weight and cost.

2. The far U.V. and I.R. are absorbed by the relatively thick liquid wall 7 thus lowering the amount of radiation which will be absorbed by the chamber wall 2.

3. The inside surface of the arc chamber 2 will absorb energy but since this surface is in intimate contact with the high flow liquid wall 7 the heat removal is very efficient. In double jacketed lamps the inside surface of the inside tube is heated while the outer surface is cooled. This sets up thermal stresses and allows the inner surface of the inside tube is heated while the outer surface is cooled. This sets up thermal stresses and allows the inner surface to become much hotter. These conditions then cause failure of the inner tube and thus lamp failure.

4. The friction encountered by the gas vortex is lowered thus maintaining a better vortex over a longer arc. This occurs because the liquid 7 and gas 9 are rotating in the same sense and the friction is due to a liquid-gas interface rather than a solid-gas. The massive liquid vortex tends to affect the gas vortex rather than be affected by it.

5. Due to the thickness of the liquid wall 7 and its velocity any material evaporated from the electrodes 3, 4 is carried away by the liquid wall 7 and thus no darkening of the solid chamber walls will occur. This will keep radiation output constant with respect to running time.

6. Because of the rapid motion of the liquid 7 through the chamber, the liquid does not experience a large increase in temperature and therefore its cooling effect on the arc column is essentially constant over the entire length of the discharge. This produces uniform arc conditions resulting in spatial uniformity of emittance from the source.

7. Because of the liquid walls 7 thickness and rapid motion, the liquid wall 7 can sustain high power fluxes. The chamber 2 may thus have a small diameter and this in turn reduces the volume filled by vortexing gas and the volume of gas circulated may be reduced by as much as a factor 20. The smaller chamber 2 will also allow fabrication of a lamp with smaller overall dimensions whereby more economical production of highly efficient reflectors may be realized. As an example, the chamber 2 diameter need not exceed 1 for chambers up to 6 feet long. However, chambers would normally be 4 inches to 12 inches long depending on power and use with diameters of ¾ inch to 1 inch. The inside diameter of the liquid wall 7 within the chamber would be approximately ½ inch to ¾ inch and the diameter of the arc column approximately 3/16 inch to ⅜ inch depending on the power required.

Figure 2:
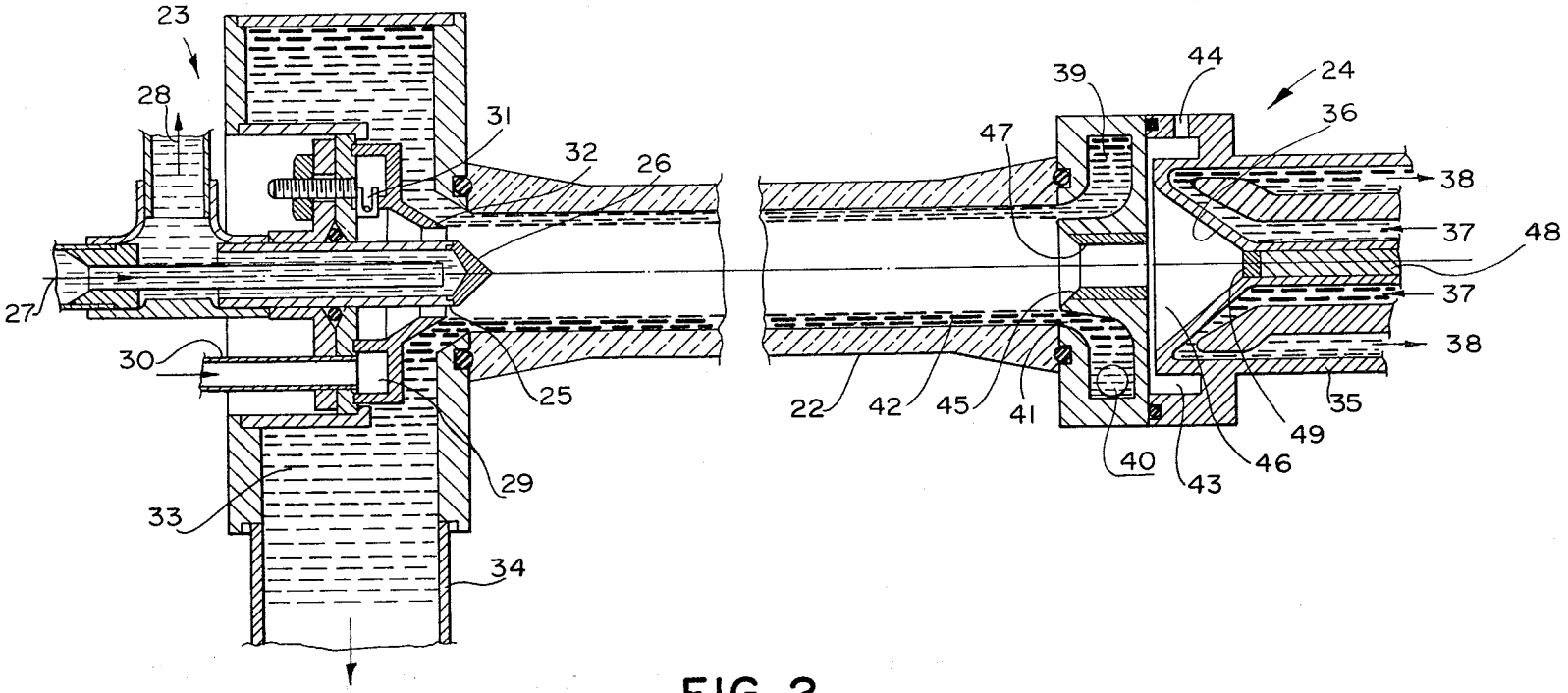
FIG. 2 illustrates in cross-section, a radiation source in accordance with this invention.

FIG. 2 shows a cross-section of on configuration the arc chamber and electrodes may take in accordance with this invention. This embodiment consists of a cylindrical arc chamber 22 made of quartz, pyrex or other material with sufficient strength to withstand the internal pressures and temperatures, and which is transparent to the arc radiation. A cathode structure 23 is mounted at one end of chamber 22 and an anode structure 24 is mounted at the other end of chamber 22 to provide spaced coaxial electrodes between which an arc is maintained.

The cathode structure 23 has a hollow electrode 25 usually made of conductive material such as copper with the cathode surface 26 made of thoriated-tungsten. Coolant is circulated through the interior of electrode 25 in any conventional manner as shown by inlet arrow 27 and outlet arrow 28. The inert gas, which may be either argon, krypton, xenon, etc. may be injected into the arc chamber 22 from either end of the chamber, however it is preferred to introduce the gas through the cathode structure 23. Though the gas would develop a vortex motion due to the vortexing liquid wall in the chamber, it is preferred to initially provide it with a tangential velocity. This is accomplished in the cathode structure 23 by providing an annular gas chamber 29 which is concentric with electrode 25 and into which the gas in introduced by inlet 30. The gas under pressure is then forced through one or more gas jets 31 acquiring a high tangential velocity. Sleeve 32 guides the vortexing gas into chamber 22 where it travels to the anode structure 24. Finally, the cathode structure includes an annular exhaust chamber 33 into which the vortexing liquid flows as it leaves arc chamber 22. The small residual vortex motion of the liquid assists it to exit via outlet 34 and return to a heat exchanger, deionizer and pump (not shown). Most of the cathode structure may be made of conductive material such as copper except for the cathode surface 26. The anode structure 24 includes a hollow electrode 35 which has a cone shaped anode surface 36 and is made of conductive material such as copper. Electrode 35 also has an anode plug 49, usually made of thoriated tungsten, at the center of the anode surface 36. Coolant is circulated through the interior of electrode 35 in any conventional manner as shown by inlet arrows 37 and outlet arrows 38. The anode structure further includes an annular chamber 39 into which coolant is introduced under pressure through inlet 40. The coolant forms a vortex which is fast enough to take the form of a hollow cylinder 42 lining the inside of the chamber 22 before it exits into cathode structure 23. The liquid used in such a system would normally be water, however other liquids having a low vapour pressure and/or a wider range of operating temperatures, could be used. Finally, the anode structure includes an annular gas exhaust chamber 43 to receive the gas as it leaves arc chamber 22. The gas is expelled through an outlet 44 to be recirculated directly or through a heat exchanger (not shown), to inlet 30 in the cathode structure 23.

As the coolant and gas are vortexing through the chamber 22, a dc or ac arc is struck and maintained between the cathode 25 and the anode 35. The arc is constricted by the liquid wall and stabilized by the gas vortex, producing high intensity radiation which is visible through the liquid vortex 42 and the transparent chamber 22.

In order to increase the life of the anode surface 36, an annular arc constriction 45 is mounted in front of the anode 35 to form a gas expansion chamber 46 between it and the anode surface 36. The constriction 45 determines the diameter of the arc column at the end of the arc chamber 22; and the chamber 46 formed, causes the gas to expand as it enters, losing its vortex motion resulting in a non-vortex stabilized arc at the anode surface 36. The constriction 45 which is also made of copper having a thoriated-tungsten interior surface 47, is preferably electrically insulated from the anode 35 but need not be insulated if the interior surface 47 is short enough in length. This anode structure provides a long life at high power since the thermal load is distributed over a larger surface allowing for more efficient cooling. Although the annular constriction 45 takes direct radiation and some heat from gas, it does not carry the anode current spot. The anode surface 36 carries the current loading but the effects are reduced because there is no vortex stabilization at this surface. This lack of vortex stabilization allows a larger anode spot to form and also rotate in an annular path, thus the current density is reduced which lowers the thermal loading.

In addition, an iron plug 48 may be used behind the anode plug 49 to facilitate the introduction of a magnetic field which has the effect of applying a magnetic pressure to the arc in such a way that the arc is kept moving in an annular path on the anode surface in a conventional manner. Since the arc foot is moving, the thermal loading of any one part of the anode is reduced. This gives a much improved electrode life.

The cathode 25 usually projects into chamber 22 as shown in FIG. 2. However, a structure, similar to constriction 41, may be placed in front of cathode 25 such that the arc will cover a greater part of its surface, as would be desired for ac arc operation.

A radiation source, as described above is found to have a luminous efficacy higher than 40 lumens per watt at 140 kilowatts. In addition, by varying the arc parameters peak outputs may be produced in the visible or at other wavelengths.

A long high pressure arc is usually struck by momentarily touching the electrodes in a gas vortex. This has the disadvantages of perturbing the gas vortex stabilization and often causing significant electrode damage. Moveable electrode systems also prove to be inconvenient if not impossible at the top of a 200 foot lighting tower.

In the present radiation source system, a three stage arc starting and supply circuit of the type shown in FIG. 3 is used which provides a voltage and current across the arc discharge as shown in FIGS. 4(*a*) and 4(*b*). Initial breakdown of the arc gap 31 is accomplished by a high voltage pulse, 30,000 to 50,000 volts, lasting approximately 0.5 $\mu$sec. which is produced by a pulsing circuit 52. Since this pulse duration is not long enough for the main power supply 53 which inherently has a large inductance to take over and maintain the arc, the pulsing circuit is adapted to discharge a low inductance programmed capacitor bank 54 across the arc 41 through switch 55. The capacitor bank 54 maintains sufficient current in the arc to sustain the arc until the main supply can take over as shown in FIG. 4a. Diode 56 is used to block reverse current flow from the capacitor bank 54 into the main supply 53 and thus must withstand a reverse voltage equal to the maximum voltage on the capacitor bank 54. In addition, it must be capable of carrying an arc current of up to 100 amperes. When the arc is running on the main power supply, a switch 57 is closed and switch 55 is opened so that the main current can now be increased to full power since it bypasses the diode 56 and the pulsing circuit 52, preventing any damage to these components.

The programmed capacitor bank may take many forms, however it is necessary that it have a low inductance and be capable of sustaining the arc for periods of from 1 msec to 100 msec with an initial current of from 20 to 200 amps depending on the size of the radiation source. FIGS. 5 and 6 illustrate the type of capacitor banks which may be used in the starting power supply circuit. In FIG. 5, the bank 60 includes a high voltage supply 61 feeding series resistors 62 and 63, and charging parallel capacitor 64. In FIG. 6, the high voltage supply 61 is again connected to resistors 62 and 63 between which a number of series inductors 64, 65, 66 are connected. A charge is then maintained on parallel capacitors 67, 68, 69 and 70, until they are discharged across the arc via the pulsing circuit as described with reference to FIG. 3.

FIG. 7 shows a cross-section of a second configuration the arc chamber and electrodes may take in accordance with this invention. It includes a cylindrical arc chamber 71, a cathode structure 72 mounted at one end of chamber 71 and an anode structure 73 mounted at the other end of chamber 71 to provide spaced coaxial electrodes between which an arc discharge is maintained.

The cathode structure 72 has a hollow copper electrode 74 with a cathode surface 75 made of thoriated tungsten. Coolant is circulated through the interior of electrode 74 in any conventional manner as shown by inlet arrow 76 and outlet arrows 77. Inert gas, such as argon is introduced into the cathode structure 72 through inlet 78 and forced through one or more inlet jets 79 to provide it with a tangential velocity. The cathode structure further includes an annular chamber 80 into which liquid is introduced under pressure through inlet 81. The liquid passed through tangential jets 82 to form a vortex which is fast enough to take the form of a hollow cylinder shaped wall within the chamber 71.

The anode structure includes a hollow copper electrode 83 with an anode surface 84 made of pure tungsten or tungsten alloys such as thoriated tungsten. Coolant is circulated through the interior of electrode 83 in any conventional manner as shown by inlet arrow 85 and outlet arrows 86. The anode structure 73 further includes an expanding chamber 87 mounted about the electrode 83 at the end of chamber 71. The expanding chamber 87 allows the liquid vortex and gas vortex to expand before the anode surface 84 enabling the arc to expand before it reaches the anode. An outlet 88 allows the gas to exit the anode structure 73. The liquid accumulates in a liquid dump chamber 89 having an outlet 90 from which it is pumped through a suitable heat exchanger and subsequently recirculated.

We claim:

1. Apparatus for providing high intensity radiation comprising:

an elongated cylindrical arc chamber having a transparent portion;

first and second spaced electrode means positioned coaxially within said chamber between which an arc discharge may be established;

means for producing a cylindrical liquid wall within said chamber by injecting a liquid having a vortex motion into said chamber to constrict the arc discharge by cooling the periphery of the arc discharge; and means for injecting an inert gas having a vortex motion into said chamber through the interior of said cylindrical liquid wall to stabilize the arc discharge.

2. An apparatus as claimed in claim 1, wherein said means for producing the cylindrical liquid wall includes:

means positioned near said first electrode means to provide the vortex motion to the liquid entering said chamber; and means positioned near said second electrode means to receive the liquid leaving said chamber.

3. An apparatus as claimed in claim 2 wherein said gas injecting means includes:

jet means positioned near one of said electrode means to provide a vortex motion to said gas entering said chamber; and means positioned near the other of said electrode means to receive the gas leaving said chamber.

4. An apparatus as claimed in claim 3, wherein said gas jet means is positioned near said first electrode means.

5. An apparatus as claimed in claim 2, wherein said gas is at a pressure at or above atmospheric pressure within said chamber.

6. An apparatus as claimed in claim 1, wherein the distance between the electrodes means is greater than five times the diameter of the arc discharge column.

7. An apparatus as claimed in claim 6, wherein the chamber has an inside diameter between ¼ inch to 1 inch.

8. An apparatus as claimed in claim 1, wherein the liquid is water.

9. An apparatus as claimed in claim 2, wherein at least one of said electrodes means includes an annular constriction means coaxially mounted adjacent to the surface of said one electrode means to provide a gas expansion chamber between said surface and said constriction.

10. An apparatus as claimed in claim 2, wherein said second electrode means includes an expanding chamber mounted about said second electrode for expanding said liquid vortex and said gas vortex to allow the arc discharge to expand at said second electrode surface.

11. Apparatus for providing high intensity radiation comprising:

an elongated cylindrical arc chamber having a transparent portion;

first and second spaced electrode means positioned coaxially within said chamber between which an arc discharge may be established;

means for producing a cylindrical liquid wall within said chamber by injecting a liquid having a vortex motion into said chamber to provide a positive dynamic impedance arc by constricting the arc discharge due to the cooling of the periphery of the arc discharge; and means for injecting an inert gas having a vortex motion into said chamber through the interior of said cylindrical liquid wall to stabilize the arc discharge.

* * * * *